US006607171B2

(12) United States Patent
Bohnacker

(10) Patent No.: US 6,607,171 B2
(45) Date of Patent: Aug. 19, 2003

(54) SHELF SUPPORTING BRACKET

(75) Inventor: Ulrich Bohnacker, Fruthwilen (CH)

(73) Assignee: Tegometall (International) AG, Lengwil (CH)

( * ) Notice: Subject to any disclaimer, the term of this patent is extended or adjusted under 35 U.S.C. 154(b) by 64 days.

(21) Appl. No.: 10/049,495

(22) PCT Filed: Jun. 5, 2001

(86) PCT No.: PCT/EP01/06384

§ 371 (c)(1),
(2), (4) Date: Apr. 19, 2002

(87) PCT Pub. No.: WO01/95764

PCT Pub. Date: Dec. 20, 2001

(65) Prior Publication Data

US 2002/0134900 A1 Sep. 26, 2002

(30) Foreign Application Priority Data

Jun. 13, 2000 (DE) ..... 200 10 499

(51) Int. Cl.[7] ..... A47G 29/02
(52) U.S. Cl. ..... 248/243; 248/246
(58) Field of Search ..... 248/243, 235, 248/239, 245, 246, 247, 250; 108/108

(56) References Cited

U.S. PATENT DOCUMENTS 4,018,167 A * 4/1977 Spangler ..... 108/152
4,033,540 A * 7/1977 Hamblin ..... 248/246
4,205,815 A * 6/1980 Sauer et al. ..... 211/192
4,373,694 A * 2/1983 Peterson ..... 108/108
5,388,796 A * 2/1995 Sullivan ..... 108/108
5,921,411 A * 7/1999 Merl ..... 108/108

* cited by examiner

*Primary Examiner*—Ramon O. Ramirez
*Assistant Examiner*—Kofi Schulterbrandt
(74) *Attorney, Agent, or Firm*—Barnes & Thornburg

(57) ABSTRACT

For stamping shelf supporting brackets of an overall L-shaped configuration from band material (13), the cutting lines are so arranged that one cut generates the upper edges (6) of two adjacent brackets rotated by 180° with respect to each other, and the subsequent cut generates the lower edges (14) of those two brackets which are contiguous to each other at this location. The cantilever portion (4) of each bracket has its free end provided with a hook portion (5) which projects from the upper edge (6) and in use serves for retaining the respective shelf. At the opposite end, the upper edge (6) of the cantilever portion (4) has a notch (7) which is shaped complementarily with respect to that part of the hook portion (5) which projects above the upper edge (6). In the stamping process, the size of waste clippings (15) is reduced by having the hook portion (5) of one bracket extend into the notch (7) of the adjacent bracket.

4 Claims, 1 Drawing Sheet

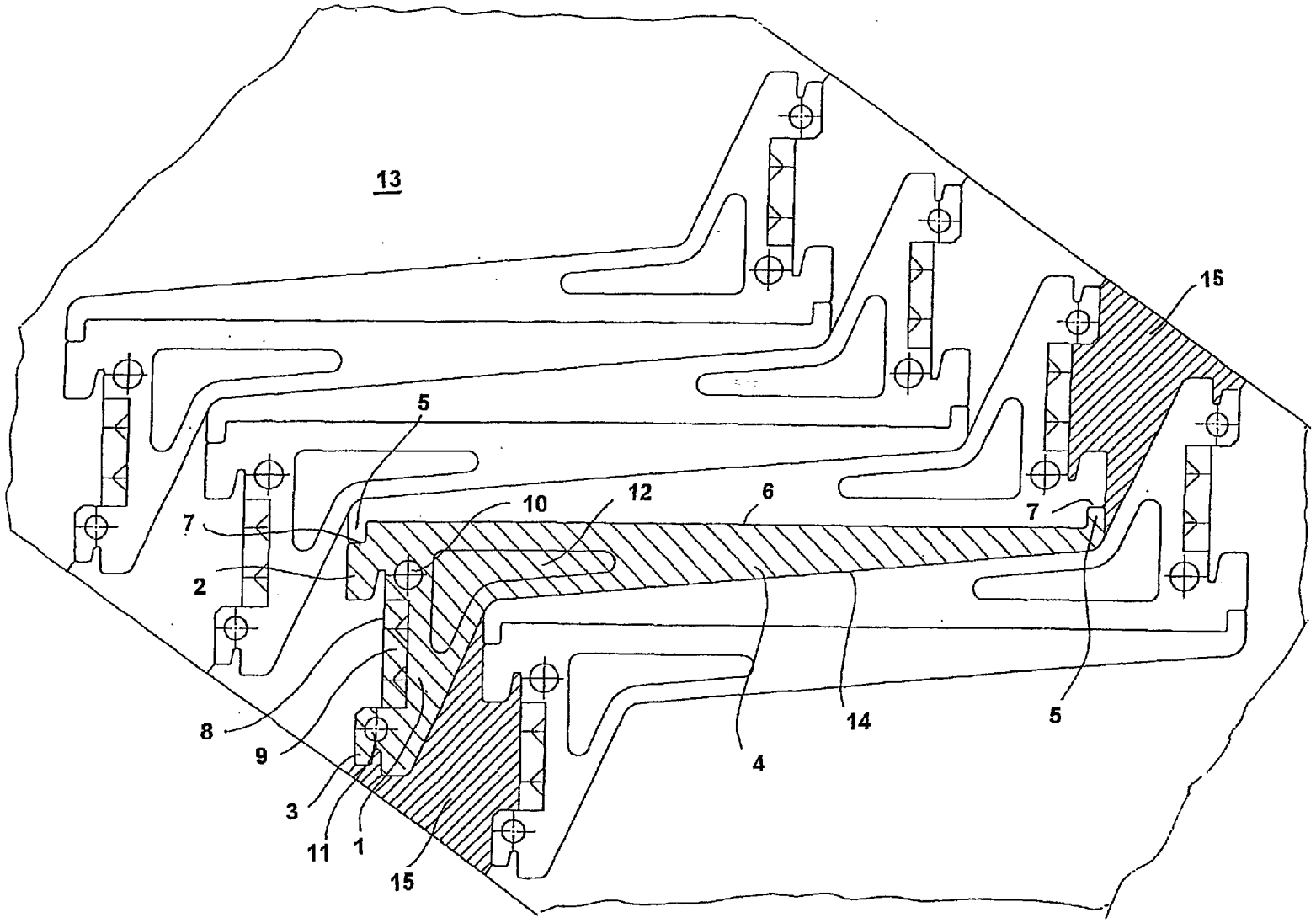
15
5
7
14
6
4
12
10
5
13
15
1
11
3
9
8
2
7

SHELF SUPPORTING BRACKET

BACKGROUND AND SUMMARY OF THE INVENTION

Shelf supporting brackets, specifically for use with light-weight metal shelving systems and designed to be attached to slotted wall uprights, are usually stamped from steel band material. In order to keep the stamping waste as low as possible, the cutting lines are so arranged that brackets alternatingly rotated by 180° are produced. Due to this arrangement, one cut will define the upper edges of the cantilever portions of two adjacent brackets, and the next cut, in the longitudinal direction of the band material, will define the lower edges of two adjacent brackets. In order to cause as little waste as possible, also at the edges of the band material, the cutting lines are arranged to extend at an angle with respect to the longitudinal direction of the steel band.

With this arrangement, a somewhat triangular clipping is generated only between the support portion, i.e. the vertical portion designed to be hooked into the wall upright, of one bracket and that of the next but one bracket.

FR 2 501 984 A discloses a shelf supporting bracket made from flat material, the upper edge of which is provided with a hook portion at one end and a chamfer at the other end. The chamfer is required to permit rotation of the bracket when it is fitted to the corresponding upright.

GB 2 042 876 A shows another shelf supporting bracket with a cut-out at the rear end of its upper edge. The cut-out allows the upper edge portion of the bracket to be bent for reinforcement, except at its rear part which is to engage a wall upright.

It is an object of the invention to reduce material waste in producing shelf supporting brackets from flat material.

To meet this object, the shelf supporting bracket of the present invention comprises a first portion having an attachment part for mounting on a vertical shelving element, and a second portion cantilevering from the first portion, the second portion having a shelf supporting upper edge and, at its free end remote from the first portion an upward projecting shelf retaining hook portion, wherein the upper edge is provided, at its end adjacent the first portion with a notch which corresponds to the hook portion.

Adjacent shelf supporting brackets are positioned relative to each other in the blank in such a way that the upward projecting hook portion extends into the notch of the adjacent bracket. This permits the brackets being stamped to be interleaved more closely, thereby reducing the size of the triangular clippings mentioned above. For a given bracket size, a material saving of about 20% is thus achieved.

The idea of providing a notch corresponding to the hook portion and to stamp pairs of brackets from the blank material in the above way, in order to save material, is not suggested in the art.

In a preferred embodiment, the attachment part has a hook portion extending in a direction opposite to that of the second portion and adapted to be hooked into an opening of a vertical shelving element, the notch being situated entirely within the part of the hook portion which engages in the opening. The notch, which achieves the material saving in the manufacturing process, does not impair the optical appearance of the shelf supporting bracket when mounted in the finished shelving.

In method of manufacturing a shelf supporting bracket according to the invention by cutting a flat material, the cutting lines are so arranged that adjacent brackets, which are mutually rotated by 180°, abut each other at their upper edges, with the hook portion of one bracket extending into the notch of the other bracket.

Preferably, the brackets are produced from band material and the cutting lines are so arranged that the upper edges of the brackets extend at an angle with respect to the longitudinal direction of the band, thereby making best use of a band of given width.

A preferred embodiment of the invention will now be explained in more detail with reference to the single drawing.

BRIEF DESCRIPTION OF THE DRAWINGS

The FIGURE illustrates a plurality of shelf supporting brackets in the mutual arrangement in which they are stamped from a steel band.

DETAILED DESCRIPTION OF THE PREFERRED EMBODIMENTS

In the drawing, one of the shelf supporting brackets has been cross-hatched in order more clearly to show the shape of each of the total of eight brackets being illustrated. The following explanation refers specifically to this cross-hatched bracket.

The shelf supporting bracket, which has an overall somewhat L-shape configuration, includes a support portion 1 with an attachment part having two tab-like hooks 2, 3 extending rearward (to the left in the drawing) for hooking the bracket into openings of a wall upright (not shown).

A second, cantilever portion 4 extends from the support portion 1 in the opposite direction (to the right in the drawing), the free end of the cantilever portion 4 having an upward extending hook portion 5. The upper edge 6 of the cantilever portion 4 defines a support surface for a shelf (not shown). The hook portion 5 is used for retaining such a shelf by engaging the front edge of the shelf or a recess provided in the lower surface of the shelf.

The upper edge 6 of the cantilever portion 4 has a notch 7 at its rear end (to the left in the drawing) remote from the hook portion 5, the notch 7 having a shape that is complementary to that part of the hook portion 5 which projects above the upper edge 6.

When hooked to a wall upright, the vertical abutment edge 8 provided by the attachment part serves to rest on the front surface of the wall upright. The part 9 which forms the abutment edge 8 of the support portion 1 is provided with an undulation for stabilising the bracket in this position.

In the hooked-in condition, the part of the bracket which is behind the abutment edge 8 (to the left in the drawing) is situated within or behind the openings of the wall upright and is therefore invisible. As shown, the notch 7 is entirely within this invisible area.

A hole 10 is provided in the support portion 1 of the bracket, substantially at the level of the upper hook 2, for suspending the bracket on a display holder bar. The hole 10 is so arranged that, in the suspended condition, the cantilever portion 4 extends essentially vertically downward.

A further hole 11 is provided within the area of the lower hook 3 for suspending the bracket during a coating process. This hole 11 is situated partly behind (according to the drawing, to the left of) the abutment edge 8 so that the part of the inner edge of the hole 10, which is not totally covered by coating, lies within the invisible are when the bracket is hooked in place.

An essentially L-shaped reinforcing embossment 12 is provided in the transitional area between the vertical support portion 1 and the horizontal cantilever portion 4 of the bracket.

As shown in the drawing, for stamping the shelf supporting brackets from a steel band generally designated by 13, the cutting lines are so arranged that adjacent brackets, which are mutually rotated by 180°, abut each other at their upper edges 6, with the hook portion 5 of one bracket extending into the notch 7 of the other. The subsequent cut generates the lower edges of mutually abutting brackets. The cutting lines are so arranged that the edges 6 and 14 extend diagonally with respect to the longitudinal direction of the steel band 13.

As shown, a substantially triangular clipping 15 is produced on both sides of the steel band 13 between the support portion 1 of one brackets and that of the next but one bracket. The size of this clipping 15 is reduced to a minimum by the fact that the hook portion 5 of one bracket extends into the notch 7 of the adjacent bracket.

Although the present invention has been described and illustrated in detail, it is to be clearly understood that this is done by way of illustration and example only and is not to be taken by way of limitation. The spirit and scope of the present invention are to be limited only by the terms of the appended claims.

What is claimed is:

1. A shelf supporting bracket produced from flat material, comprising:

a first portion having an attachment part for mounting on a vertical shelving element;

a second portion cantilevering from the first portion;

the second portion defining a shelf supporting upper edge and having, at its free end remote from the first portion, an upward projecting shelf retaining hook portion; and the upper edge having, at its end adjacent the first portion, a notch having a shape which is complementary to a shape of the hook portion.

2. The bracket of claim 1, wherein the attachment part has a hook portion extending in a direction opposite to that of the second portion and adapted to be hooked into an opening of a vertical shelving element, the notch being situated entirely within the part of the hook portion which engages in the opening.

3. A method of manufacturing a shelf supporting bracket according to claim 1 comprising:

cutting a flat material along cutting lines; and the cutting lines being so arranged that adjacent brackets are mutually rotated by 180° and abut each other at their upper edges, with the hook portion of one of the adjacent brackets extending into the notch of the other.

4. The method of claim 3, wherein the brackets are produced from a band and the cutting lines are so arranged that the upper edges of the brackets extend at an angle with respect to the longitudinal direction of the band.

* * * * *